US005890838A

United States Patent [19]

Moore, Jr. et al.

[11] Patent Number: 5,890,838

[45] Date of Patent: Apr. 6, 1999

[54] STORM WATER DISPENSING SYSTEM HAVING MULTIPLE ARCHES

[75] Inventors: Roy E. Moore, Jr., Chester; James M. Nichols, Old Saybrook, both of Conn.; Bruce T. Sperry, Jr., McGaheysville, Va.

[73] Assignee: Infiltrator Systems, Inc, Old Saybrook, Conn.

[21] Appl. No.: 744,729

[22] Filed: Oct. 29, 1996

Related U.S. Application Data

[60] Provisional application No. 60/008,999, Dec. 21, 1995.

[51] Int. Cl. [6] ..... E02B 11/00

[52] U.S. Cl. ..... 405/49; 405/43

[58] Field of Search ..... 405/49, 46, 45, 405/43, 36, 44, 47, 48

[56] References Cited

U.S. PATENT DOCUMENTS

| | | | |
|---|---|---|---|
| 3,416,321 | 12/1968 | Saad et al. . | |
| 4,154,157 | 5/1979 | Lascelles | 405/43 |
| 4,360,042 | 11/1982 | Fouss et al. | 405/49 |
| 4,523,613 | 6/1985 | Fouss et al. | 405/49 |
| 4,759,661 | 7/1988 | Nichols et al. | 405/49 |
| 4,824,287 | 4/1989 | Tracy | 405/49 |
| 5,087,151 | 2/1992 | DiTullio | 405/49 |
| 5,129,758 | 7/1992 | Lindström | 405/48 |
| 5,511,903 | 4/1996 | Nichols et al. | 405/49 |
| 5,556,231 | 9/1996 | Sidaway et al. | 405/49 |

OTHER PUBLICATIONS

"The Maximizer Chamber System for Stormwater Management" Infiltrator Systems, 1995.

"The Engineered System For Total Stormwater Management" 4–page brochure, undated, Infitrator, Inc.

*Primary Examiner*—David J. Bagnell
*Assistant Examiner*—Frederick L. Lagman
*Attorney, Agent, or Firm*—C. G. Nessler

[57] ABSTRACT

In a system for dispersing stormwaters beneath the earth surface, a pair of arch shaped corrugated molded plastic chambers lie parallel each to the other upon a bed of gravel and are covered with soil. A bridge cover spans the space between the sidewalls of the adjacent chambers, to keep soil above from entering. Abutting base flanges establish the chamber spacing which fits the bridge cover and also protect the gravel at the bottom of the space from erosion. Stormwater is delivered to the space, to then flow through sidewall perforations into the chambers' interiors where it is stored and gradually dispersed into the earth. Debris settles in the pocket at the bottom of the space and is removed by a perforated pipe lying in the space. Chambers have high aspect ratios, of 0.8 to 1 or more, and steep sidewall angles, of less than 15 degrees.

31 Claims, 4 Drawing Sheets

STORM WATER DISPENSING SYSTEM HAVING MULTIPLE ARCHES

This application claims the benefit of Provisional Application Ser. No. 60/008,999, filed Dec. 21, 1995.

1. Technical Field

The present invention relates to means for dispersing liquids in granular materials, more particularly, to systems for dispersing storm waters within soil of the earth.

2. Background

In urban and industrial development, engineers often provide for handling the volumes of rainwater which fall upon the earth from time to time. Traditionally, large storm sewers, with or without surface detention basins, have been used. However, there are adverse environmental effects from such. They include the costs of land used for detention basins, lake and stream pollution and erosion due to storm sewer runoff, and lowering of local water tables when water is diverted from percolating into the earth.

Consequently, it is desirable to direct storm water into the earth. This has been done, such as by using large gravel or crushed stone filled trenches, with and without perforated pipes running through the stone. Stone filled systems are inefficient in that the stone occupies a substantial part of the trench void, thus limiting the ability of the system to handle large surge volumes associated with heavy storms. And both the stone and the perforated pipe are susceptible to clogging by debris carried by water.

Arch shaped molded plastic leaching chambers, especially those sold under the Infiltrator brand name, and having design features like those shown in various patents mentioned herein, have met wide commercial success in the USA, especially for dispersing the waters associated with domestic sewage systems. Such leaching chambers have also been used in receiving storm waters, detaining them for regulated flow, and for dispersing them beneath the surface of the earth. Typically, the chambers are laid side by side in parallel rows. They rest on and are surrounded by gravel or crushed stone. While such installations provide greater void volume than the stone trench systems, and have been in many instances satisfactory, further improvements are desirable as indicated just below.

Subsurface storm water systems using known technology can take up large surface areas, since a normal design criterion is that the system be able to handle and store for gradual dispersal of a large volume of rainwater. Thus, where land is expensive it is very desirable to maximize various aims. Among those aims are: First, the volumetric storage capacity of the system on a unit land surface area basis should be maximized. Second, the system should be adapted to resist the loads imposed by other uses of the surface of the land, most commonly for motor vehicle parking or driving. Third, the system should be resistant to clogging and degradation caused by sand, dirt and other debris which may be carried along with the water. And, of course, the system should be economic, durable and maintainable.

SUMMARY

An object of the invention is to provide a subsurface storm water dispersing system which has a high capacity for surge volume relative to the land surface area occupied, but which at the same time is structurally strong in resisting surface weight loadings. Another object is to provide a stormwater system having improved resistance to clogging from debris, and to enable removal of such debris as is carried into the system by stormwater. A still further object is to provide subsurface leaching chambers which are especially resistive to vertical loads, and chambers which have liquid dispersing character specially suited to arid soils.

In accord with the invention, a subsurface stormwater system is comprised of chambers running parallel to one another, with the space between any pair of chambers being spanned by a bridge cover resting on imposts of the chambers. Preferably, the imposts are lower than the elevation of the highest part of the top of the chamber. The system is typically laid on a flat bed of stone or the like, and covered over with soil or the like. The system has means for enabling flow of stormwater between a chamber and the space, such as perforations in a chamber sidewall. Water is preferably flowed first into the space between any chamber pair, and then into the chambers, to disperse or leach into the stone or soil at the chamber bases.

In preferred practice of the invention: Chambers have a height to width aspect ratio of 0.8:1 or more, and sidewall angles with the vertical plane of less than 15 degrees, to provide strength and load carrying ability to the system. Chamber walls are arcuate, or bowed, as viewed in a horizontal cross section plane, to increase sidewall and system strength. The bridge covers are arched, and the highest part of the top of the bridge cover arch is at about the same elevation as the highest points of the chambers. And, base flanges of adjacent chambers abut or interlock to define the pitch of the chambers, thereby defining the center-to-center and impost-to-impost spacings of the chambers, while protecting the material at the bottom of the space from erosion due to liquid falling into the space, when the flanges are continuous along the length of the chamber bases.

The means for enabling flow between the space and the adjacent chambers is preferably perforations in the sidewalls of the chambers. More preferably, the perforations are only located at an elevation higher than the base, so water introduced into the space between a chamber pair first accumulates in a cavity at the bottom of the space, and then flows into the chambers, thereby inducing some of dirt and debris in the water to settle out in the cavity.

Further, in the preferred practice of the invention: The ends of the chambers, as well as the ends of the spaces between adjacent chambers, are closed by endplates. Pipes fit openings in the endplates of the spaces, to deliver stormwater to the chamber assembly. It is intended that debris accumulate in the space and thus, in another aspect of the invention, means, such as a pipe with perforations, is laid at the bottom of the space. Water flowed through the pipe is used to agitate and suspend the debris, which then preferably flows out the same pipe to a discharge point, such as a sump.

The invention efficiently receives, stores, and disperses storm waters; and it is particularly strong. The chambers are economical, durable, efficiently shipped and easily installed.

The foregoing and other objects, features and advantages of the invention will become more apparent from the following description of the best mode of the invention and accompanying drawings.

DESCRIPTION

The stormwater chambers of the invention have many structural and material characteristics like molded plastic leaching chambers known in the prior art. Reference should be made to U.S. Pat. No. 4,759,661, U.S. Pat. No. 5,401,116 and U.S. Pat. No. 5,401,459, having common ownership, and inventorship in part, the disclosures of which are hereby incorporated by reference. Stormwater chambers of the present invention are preferably fabricated by gas-assisted injection molding of predominantly high density polyethylene, and have plastic flow channels, which also aid strength, in accord with U.S. Pat. No. 5,401,459 and the general art. Other plastic material and process combinations may be employed.

Typically, an array of chambers, sometimes called a "system", is installed by digging a hole in the earth and creating within it an essentially planar surface of gravel or crushed stone. The chambers are mated end-to-end in parallel rows and laid on the gravel surface. After the system is installed in accord with the description below, it is covered with suitable soil. The following preferred embodiments of the invention are largely described in terms of two adjacent chambers, being illustrative of a large system comprised of many parallel rows of chambers.

Figure 1:
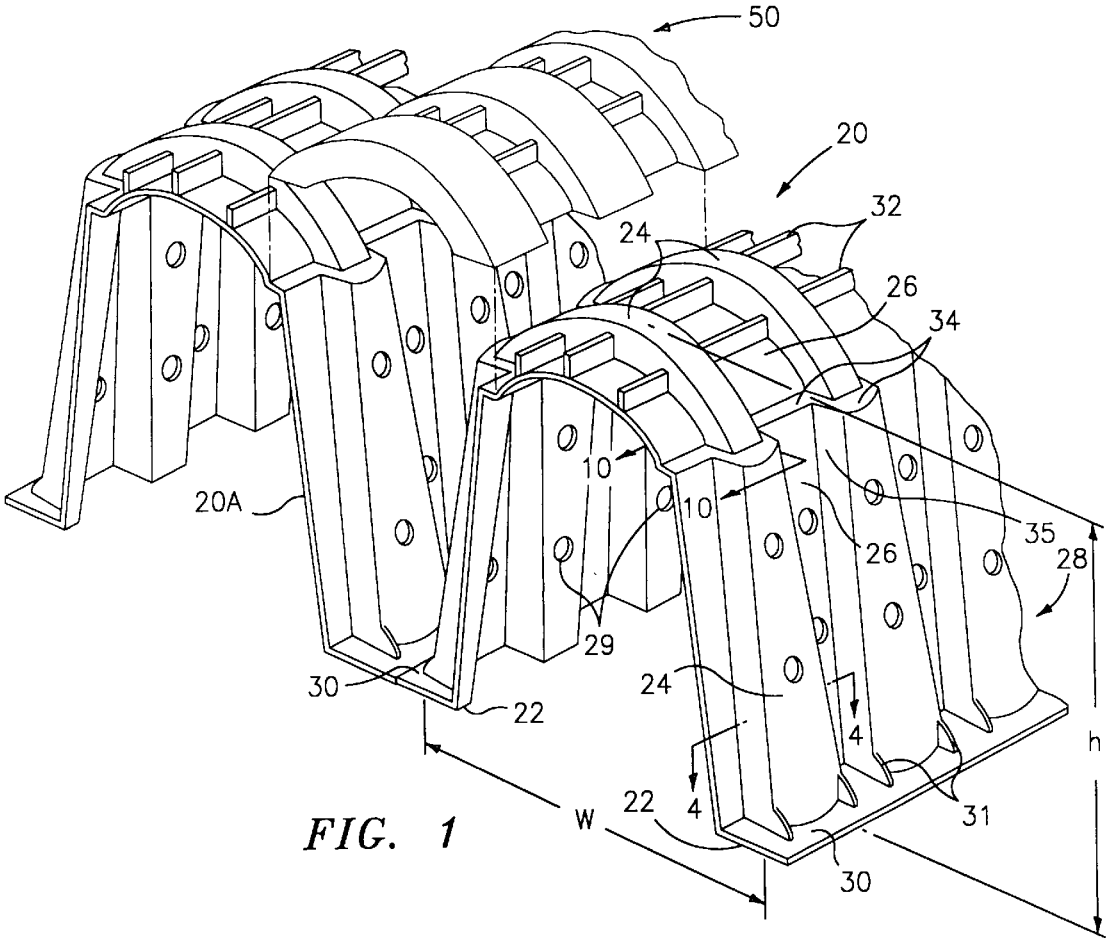
FIG. 1 is a perspective end view of part of a stormwater chamber, with a cover bridge, and with an adjacent chamber shown in phantom.
Figure 2:
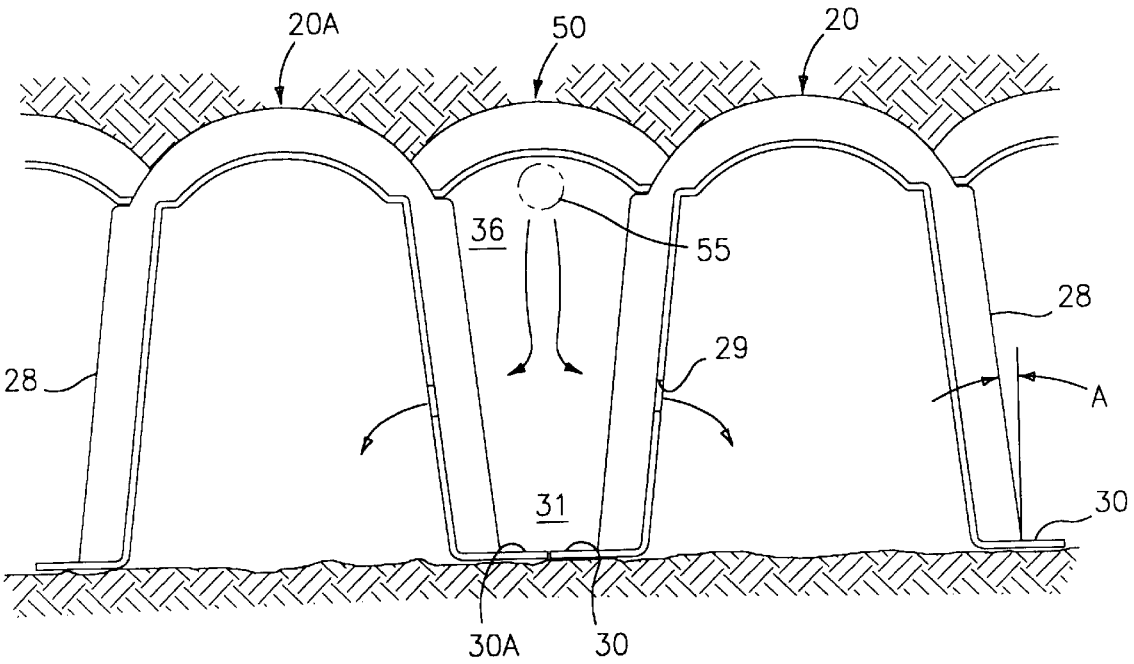
FIG. 2 is an end view of a pair of adjacent chambers buried within soil, having a cover bridge spanning the space between them.

An end fragment of a preferred chamber 20 is shown in FIG. 1, along with a bridge cover 50 and a portion of a like adjacent chamber 20A, in phantom. FIG. 2 shows the chamber 20 in end view and paired with chamber 20A, and part of a larger array, as they appear installed on a gravel bed and covered over with gravel or soil. Referring to both Figures, the chamber 20 has an arch shape cross section and is corrugated, with alternating peaks 24 and valleys 26 running up the opposing sidewalls 28 and across the top of the arch shape cross section. Peaks and valleys are connected by webs 35. The highest point of the top has a height h and the base has a nominal width w. Stiffening webs, such as ribs 32, are used on the exterior and interior of the chamber, for additional strengthening, as generally taught by the prior art. When using the gas assisted injection molding process some of the ribs and other chamber parts will be desirably hollow. The chamber 20 has a base 22 with flanges 30 extending laterally outward, for supporting the chamber and resisting vertical loads, and for the other purposes described below. Ribs 31 strengthen the base flange.

Preferred chambers have an arch shaped cross section and are about 2.2 m long, 86 cm wide and 76 cm high. They are designed to nest, one within the other, for easy shipping. Familiar commercial leaching chambers of the type described in the aforementioned patents and others commercially known have comparatively low aspect ratios in the range 0.36 to 0.65, where aspect ratio of height h to nominal base width w. Width w is measured between the opposing outermost (peak) parts of the sidewalls, where they intersect the base; and this dimension is nominally the same as the width measured between the outermost edges of the flanges 30 in most chambers, since most chambers do not have exceptionally wide flanges.

In the invention, the aspect ratio is high, preferably greater than 0.7:1, more preferably about 1:1. Table 1 compares the dimensions and aspect ratios of prior art chambers with the present invention. The high aspect ratio invention chambers are generally useful for leaching without using the bridge covers feature, as prior art chambers are. The invention chambers provide superior strength and improved liquid disperal at the sidewall relative to the base. They are especially suited for arid soils, and reduce the surface area of land which must be utilized for a given domestic sewage leaching capacity. An array of parallel chambers can be buried within crushed stone for stormwater dispersal.

The preferred high aspect ratio chamber has sidewalls 28 running upwardly at a nominal angle, measured from the vertical plane, in the range of 6.3 to 8.7 degrees. Because, as described herein, sidewalls are arcuate in the horizontal plane, the nominal sidewall angle is determined from the hypothetical inclined plane which rests on the tops of the peaks, or in the bases of the arcuate valleys, as the case may be, as they run vertically up the sidewall. And, while current commercial practice is mostly to make the sidewalls essentially straight when viewed in end cross section, some commercial chamber sidewalls have a curved arch shape when viewed in end cross section. For such, the sidewall angle plane might be taken as a best fit, or in limiting cases, there is no ascertainable sidewall angle in the context of this aspect of the present invention. The most preferred

TABLE 1

Typical/nominal parameters of leaching chambers.

| Chamber Product | Side-wall Angle (degree) | h | w inch | l | Aspect Ratio h/w |
|---|---|---|---|---|---|
| HES | 15 | 11.8 | 33 | 74.9 | 0.36 |
| HEC | 15 | 18.3 | 33.3 | 75 | 0.54 |
| C180 | ** | 13 | 34 | 84 | 0.39 |
| C330 | ** | 30.5 | 52 | 90 | 0.64 |
| U.S. Pat. No. 5,441,363 | 18 | 10* | 20* | | 0.50 |
| BDI | 20 | 11 | 34 | 77 | 0.32 |
| BDII | 25 | 12 | 34 | 76 | 0.35 |
| U.S. Pat. No. 5,087,151 | 28 | 7.5* | 11.5* | | 0.65 |
| TD | 28 | 12 | 34 | 90 | 0.35 |
| ISIS | 20 | 12 | 34 | 75 | 0.35 |

TABLE 1-continued

Typical/nominal parameters of leaching chambers.

| Chamber Product | Side-wall Angle (degree) | h | w inch | l | Aspect Ratio h/w |
|---|---|---|---|---|---|
| ISIH | 19 | 16 | 34 | 75 | 0.47 |
| Typical Invention | 8 | 30 | 30 | 87 | 0.99 |

Legend:
w = width, the maximum wall-to-wall spacing at the plane of chamber base
h = maximum height of a chamber peak measured from plane of base
l = length
*= arbitrary units from scaling of patent drawing
** = no data chamber of the present invention has an essentially straight sidewall, viewed in cross sectional plane, with an angle of 8 degrees from the vertical. This incline compares to prior art chamber sidewall angles of from 15 to 22 degrees. The sidewalls of the invention are thus more nearly vertical. In the generality of the invention chambers will have a nominal sidewall angle of less than 15 degrees, preferably in the range 5–14 degrees, more preferably about 7–9 degrees, as measured from the vertical longitudinal plane of the chamber. The combination of both higher aspect ratio and lesser sidewall angle, compared to leaching chambers heretofore used in storm water systems, provides superior strength and increases the load which the bridge cover—and thus the system—can bear.

Figure 4:
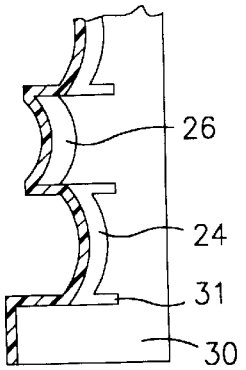
FIG. 4 is a horizontal plane cross section of part of the sidewall of the chamber of FIG. 1, showing the arcuate shape of the sidewall.

The opposing sidewalls 28 of the chamber 20 have perforations 29 in the form of about 3.2 cm diameter holes. They are located in either or both the valleys and peaks of the sidewalls. The lowermost perforation is at an elevation of about 38 cm from the base for reasons described below. To provide stiffness and buckling resistance, the peak and valley corrugations of the sidewalls are arcuate, preferably bowed outwardly (concave side facing the chamber interior) with radii of about 5.3 inch, as viewed in the horizontal cross section plane of the chamber, and as illustrated by the mid-elevation horizontal plane cross section of chamber sidewall in FIG. 4.

When chambers are buried in the earth, the outermost sidewalls of the system will of course not have bridge covers. The perforations in any such sidewalls are either plugged or covered with a fabric to prevent intrusion of the covering earth.

Referring again to FIGS. 1 and 2, the top of the chamber 20 has peaks and valleys which are continuations of peaks and valleys of the opposing sidewalls; the top comprises nominal segments of a circular arch. Imposts 34, in the form of flat ledges, are molded into the chamber at the upper end of the sidewall, where the curved arch segments of the top of the chamber start, to receive a bridge cover 50 as detailed below. In other embodiments, the imposts may be located higher up, on the top, or lower down the sidewall.

Figure 5:
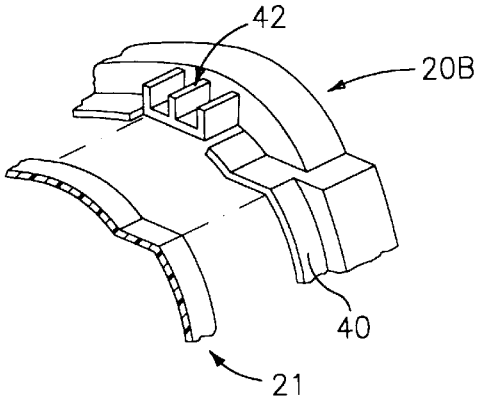
FIG. 5 shows how the ends of chambers mate with a strong joint, when put together as a string of chambers.

As in the cited prior art patents, chambers have mating ends and are connected one to the other to form strings; and, the mating ends overlap and interlock as illustrated by the fragments of mating chambers 20B and 21 in FIG. 5. (The end joint interlocking features are omitted from FIG. 1 for clarity.) FIG. 5 shows how the end of chamber 21 overlaps the flange portion 40 of the end of the chamber 20B; and, typical leg 42 overlaps chamber 21 at the joint, to strengthen the connection, in accord with the principles taught by U.S. Pat. No. 5,401,116 and other prior art. Likewise, the bridge covers, which typically are half the length of the chamber, are preferably provided with ends which overlap to prevent infiltration of soil, and they may also be interlocked with each other to increase vertical load resistance.

Strings of chambers are installed side by side, running in parallel rows, at predetermined spacing. Preferably, the chamber-to-chamber spacing is determined by butting the flanges 30, 30A of adjacent chambers, as shown in FIGS. 1 and 2. The shape and spacing of the sidewalls of the abutting chambers defines the width of the space 36 therebetween and the spacing of the imposts. When in place, a corrugated arch shape bridge cover 50 rests upon and is supported by the imposts of adjacent parallel chambers. The bridge cover fits and laps onto the impost surfaces in a way designed to prevent passage of soil or gravel into the space between the chambers from above. Most simply, the bridge cover is molded in one piece without perforations and is impermeable to soil or water.

FIG. 1 illustrates how the preferred impost is continuous, with a portion running along the top of typical web 35 connecting a peak corrugation with a valley corrugation. In the preferred embodiment, the impost is a ledge and the bridge cover outer edge runs continuously along the ledge. Within the generality of the invention, an impost is a feature of the chamber exterior surface which is adapted to receive and locate a bridge cover and provide vertical support. Preferably, it provides resistance to lateral motion when cooperating with the bridge cover features where it contacts the impost. Alternative kinds of imposts may comprise such integral features as flats, ridges, pins, bosses, cavities and holes in the chamber wall. For such alternatives the bridge cover will have appropriate mating feature.

Figure 10:
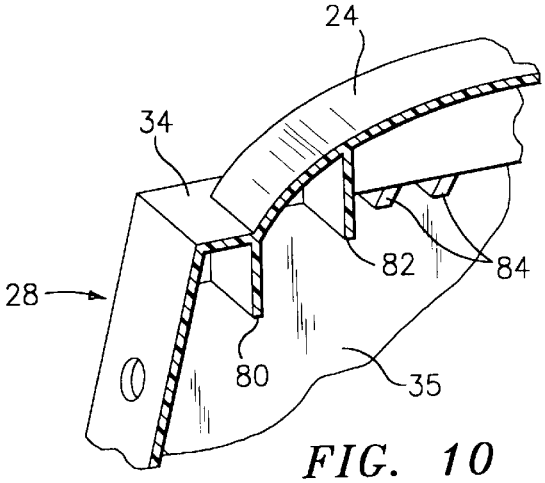
FIG. 10 shows in perspective cross section part of the peak section of chamber 20 of FIG. 1, revealing internal strengthening ribs.

FIG. 10 shows how the impost 34 and general structure in vicinity of the peak corrugation 24 is strengthened by ribs 80, 82 running lengthwise along the chamber and smaller gusset ribs 84 under the impost running between the top of the web and the underside of the impost.

Figure 9:
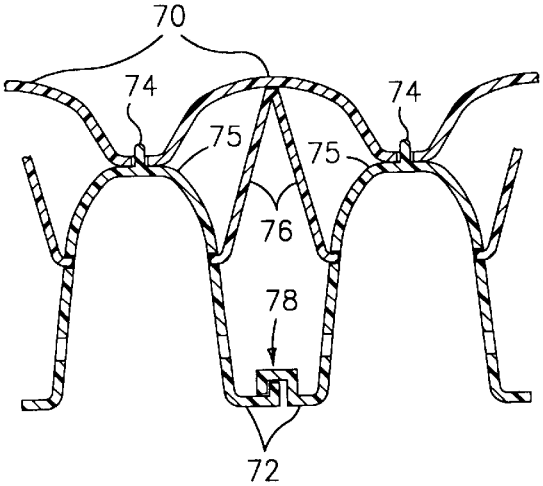
FIG. 9 shows in end view a system where a bridge covers is supported on the very tops of the adjacent chambers, the chamber base flanges interlock, and there are internal struts to strengthen the cover.

FIG. 9 shows an unperforated arch shape molded bridge cover resting on impost surfaces 75 at the tops of adjacent perforated-wall chambers 72. Vertical fins 74 running lengthwise along the chamber top define the inner edges of the opposing imposts on the chamber top, and restrain the bridge covers from lateral motion, as discussed below.

Preferably, as shown in FIG. 2, the very top of the arch of the bridge cover is at the same elevation as the very top of the arches of the chambers, to provide a relatively even surface and maximize system storage capacity for a given depth of system. In the generality of the invention, the top of the bridge cover may be either higher or lower than the tops of the chamber arches.

Figure 7:
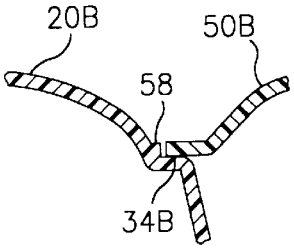
FIG. 7 shows in vertical transverse plane section how an impost has a buttress to better retain an arch shape bridge cover in place.

When an arch shape bridge cover rests on the imposts and vertical loads are applied, such as from a motor vehicle passing across the earth above, an arch shape cover bridge will tend to flatten out and expand in width. Thus, the edge of the cover bridge will tend to move laterally, to bear against the curved rising part of the chamber top, so the motion will be resisted to a degree. Even better resistance to lateral deflection is obtained when a protrusion, such as buttress 58 is molded into the chamber adjacent the impost, as shown in FIG. 7. See also fins 74 in FIG. 9. Alternative lateral restraint means, such as screws or pins may also be employed, provided there is accommodation for slight relative motion of the parts under changes in vertical load, to avoid local failure of the plastic chamber or bridge cover material. In alternative embodiments, the bridge cover may have molded plastic tabs or pins that engage mating features in vicinity of the imposts. In still other embodiments, additional structural members, integral or separate from the bridge cover, may improve vertical strength of the bridge cover. For instance, strut members may extend vertically from the bottommost of the space between the chambers, or struts 76 may angle up from the chamber walls, as shown in FIG. 9.

Figure 8:
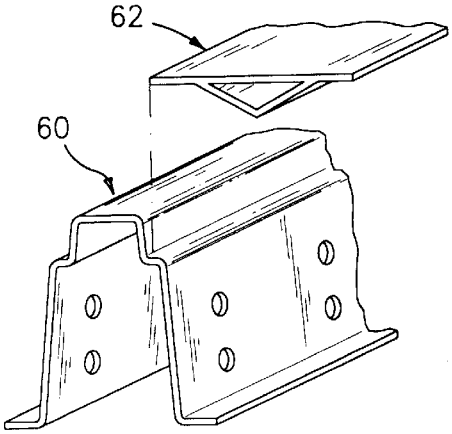
FIG. 8 shows a non-corrugated chamber with a relatively flat top and a lintel type bridge cover.

A chamber embodying the invention principles may have smooth rather than corrugated sidewalls and top, as shown for chamber 60 in FIG. 8. And, bridge covers may have cross section shapes other than the preferred arch shape. For instance, a lintel type bridge cover 62 is shown in FIG. 8, where the lintel cross section is molded as a simple truss. And, while the bridge cover is ordinarily unperforated and impermeable, in some instances small perforations may be present to better enable any liquid above the system to percolate into it.

In the preferred embodiment, the width of the bridge cover (i.e., the length of span from one impost to another) is a bit less than the width of the bases of the chambers on which the bridge cover rests, or the center-to-center distance between the chambers. In other embodiments, the bridge cover may be equal to or wider than either such.

Figure 3:
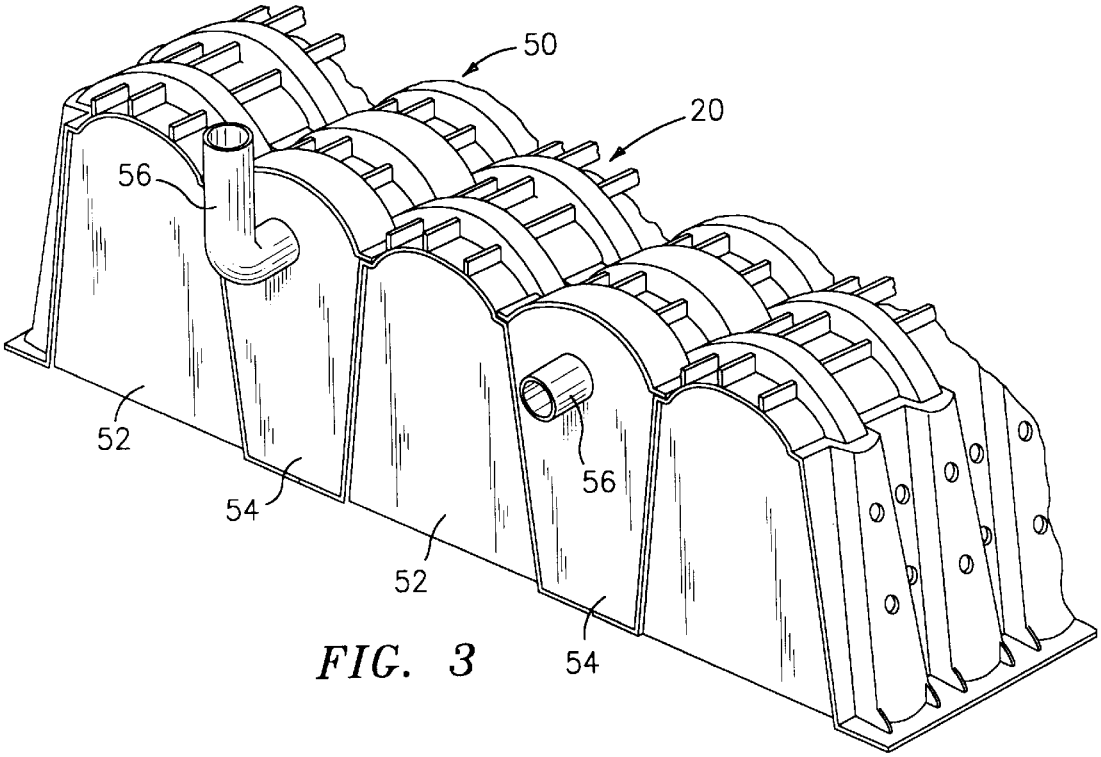
FIG. 3 is a perspective view of the ends of an array of parallel lying chambers having endplates, showing how stormwater is delivered by pipes to the spaces between the chambers.

Chambers may have various arch shape cross sections, including those which are rectangular, trapezoid, triangular, etc. Chambers may be molded with integral closed ends, but preferably they have open ends. The ends of strings of chambers are typically closed by end plates 52 which fit into the chamber end openings as shown in FIG. 3. Endplates are held in place by detents, screws or the like. Bridge cover endplates 54 having similar construction and function close off the ends of the spaces 36 between adjacent chambers. As with the chambers, the bridge cover endplates may be made integral, but preferably they are separate pieces.

Figure 6:
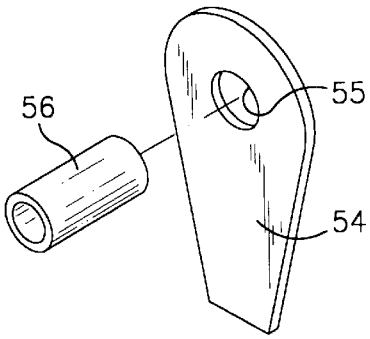
FIG. 6 shows an endplate for one of the spaces between a chamber pair.

Preferably, the bridge cover endplates have ports or openings 55, to receive pipes 56 carrying stormwater from catch basins to the chamber system. See FIGS. 3 and 6. Alternately, the bridge covers may have top openings, so the stormwater is delivered vertically downward into the spaces. Thus, water is preferably flowed to the chamber system by entering through the space endplates and falling to the bottom of spaces 36 between the chambers. While water is preferably introduced by flowing it directly into the spaces, it may be alternatively delivered into the chambers, or both. It is not necessary that every space or chamber, as the case may be, have direct delivery of storm water.

As mentioned, perforations 29 in the chamber sidewall preferably are a distance above the base, to create a cavity or pocket 31 at the bottom of space 36, near the chamber base where liquid introduced through openings 55 will accumulate before flowing through the perforations into the interior of the chambers. See the arrows indicating liquid flow in FIG. 2. Such construction enables a significant portion of the dirt and other debris carried by the water to settle out at the region or cavity 31 at the bottom of the space 36 when the water is storm water is piped into the space.

Preferably, the chamber base flanges 30, 30A abut to set the center-to-center dimension which fits the bridge covers, and they are continuous to cover the soil at the bottom of the space 36 and protect it from being eroded by incoming water, or by suctioning away of debris if such means is employed. Abutting chamber flanges may be overlapped or engaged one with the other along their lengths to limit lateral chamber movement and ensure positive locating, as illustrated for the flange connection 78 in FIG. 9.

Generally, flanges can be discontinuous, and irregular in lateral dimension while serving the chamber spacing function. When flanges are not constructed to set chamber spacing, other built in gaging means, manual measuring, or other fixturing may be used to achieve the spacing which fits the bridge covers.

The chamber sidewall perforations preferably have a total area sufficient to enable good fluid flow or communication between the chambers and the spaces therebetween, relative to the size and capacity of the inlet pipe and chambers. Perforations other than round holes may be used, such as slots. In the generality of the invention, other means for connecting the chamber with the space than sidewall perforations may be used. For example, the parts of the system may be connected by external piping; or, when the settling cavity feature in the space is not required, the means may comprise cutouts at the base flange.

Figure 11:
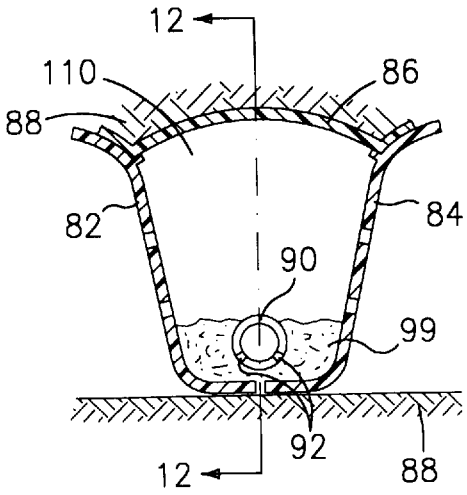
FIG. 11 shows an end cross section of the space between two chambers where debris and a conduit lie at the bottom of the space.
Figure 12:
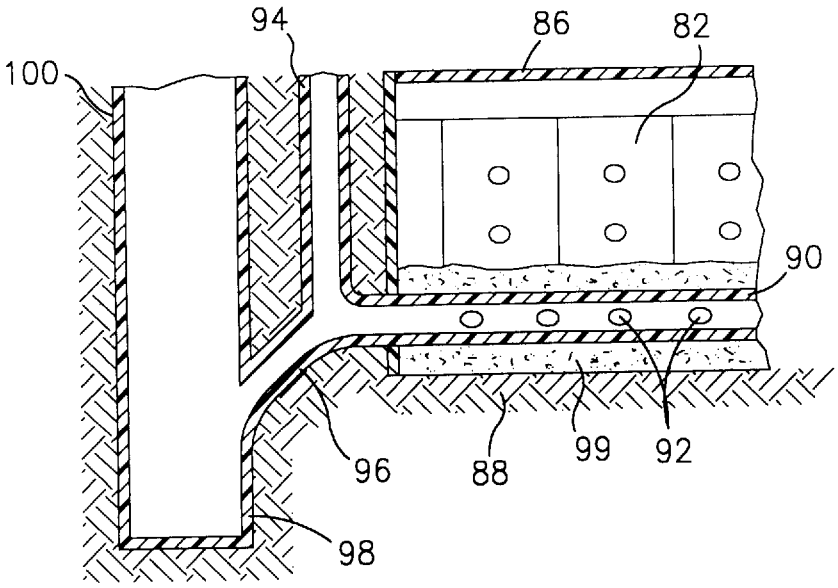
FIG. 12 shows an longitudinal cross section of the space shown in FIG. 11, together with the conduits which enable water to be introduced into the space and the resultant suspended debris to be removed by gravity flow to a sump.

FIGS. 11 and 12 show how debris removal is conveniently enabled by a perforated pipe 90 laid in the bottom of the space 110 created by chambers 82, 84 and bridge cover 86. Settled out debris 99 is shown as it would accumulate in the cavity at the bottom of the space. The pipe has a multiplicity of longitudinally spaced apart and downward facing holes 92. To remove the debris a flexible hose having a jet nozzle is lowered down the channel 94, typically another pipe connected to pipe 90, so that it passes along the length of pipe 90 within the chamber, to the desired extent. Pressurized water issuing from the nozzle flows through the holes 92, to agitate and temporarily suspend the debris in the water in the cavity. When pressurized water flow is ceased, or moved to a sufficiently distant point along the pipe, debris-laden water flows out the pipe 90, down the diversion channel 96 and into the sump 98. From there it may be removed up access channel 100, typically a larger diameter pipe or shaft. In an alternate embodiment, the line 90 may be used only for agitating and a separate pipe or channel may be used for flowing the debris away.

Although only the preferred embodiment has been described with some alternatives, it will be understood that further changes in form and detail may be made without departing from the spirit and scope of the claimed invention.

We claim:

1. An assembly for receiving and dispersing liquid when buried beneath soil, comprising:

a pair of molded chambers, each chamber having an arch shaped cross section defining a chamber hollow interior, a base, a top, and opposing sidewalls running from the base to the top;

the chambers lying adjacent and parallel to each other on an essentially flat surface, the adjacent sidewalls of the chamber pair shaped and positioned relative to each other to create a space therebetween;

means for enabling liquid flow between the interior of at least one chamber and said space;

each chamber having an impost on its exterior surface for supporting a bridge cover; and, a bridge cover spanning said space, running from the impost of one chamber to the impost of the other chamber, for preventing soil from locally entering said space from above when the assembly is buried in soil.

2. The assembly of claim 1 wherein the span, or width, of the bridge cover is less than the center-to-center spacing between the pair of chambers.

3. The assembly of claim 1 wherein the bridge cover is arch shaped.

4. The assembly of claim 3 wherein the highest part of the top of the bridge cover is nominally at the same elevation as the highest parts of the tops of the adjacent chambers.

5. The assembly of claim 3 wherein the highest part of the top of the bridge cover is at a lower elevation than the highest part of the tops of the adjacent chambers.

6. The assembly of claim 1 wherein each chamber has corrugations comprised of peaks and valleys running up the sidewalls and transverse to the chamber length; further comprising an arch shaped bridge cover having corrugations running transverse to the lengths of the chambers.

7. The assembly of claim 6 wherein at least one of the peaks and valleys of the sidewall at least one of the chambers has an acurate shape, as measured in a plane parallel to the base of the chamber.

8. The assembly of claim 7 characterized by each chamber having a sidewall sloped inwardly at an angle of less than 15 degrees with the vertical plane.

9. The assembly of claim 8 wherein the sidewall angle is about 6 to 9 degrees.

10. The assembly of claim 1 wherein the impost of each chamber is at an elevation lower than the highest part of the top.

11. The assembly of claim 1 comprising at least one chamber having means, located proximate the impost, for limiting motion of the bridge cover transverse to the length of the chamber.

12. The assembly of claim 1 wherein the means for enabling liquid flow comprises perforations in the sidewall of at least one chamber.

13. The assembly of claim 12 wherein the sidewall of said at least one chamber has all perforations located at an elevation higher than the elevation of the chamber base, so liquid first introduced into the assembly at said space accumulates in a cavity at the bottom of the space before flowing through one or more perforation into the interior of said at least one chamber.

14. The assembly of claim 1 further comprising a bridge cover endplate, for closing off the end of the said space at the end of the chamber pair.

15. The assembly of claim 14 wherein the bridge cover endplate further comprises means for receiving a liquid-transporting conduit, to enable introducing liquid into said space from an external source.

16. The assembly of claim 1 wherein each chamber has a flange running along at least part of the length of the base, the flange extending laterally toward the other chamber of the pair; the flanges of the pair of chambers abutting each other, to thereby establish between imposts of the pair of chambers a desired spacing which fits said bridge cover.

17. The assembly of claim 16 wherein the flanges of the adjacent chambers interlock, to limit movement of one chamber away from the other.

18. The assembly of claim 16 wherein the flanges are continuous along each chamber length and cover the surface on which the chambers lie at the bottom of the space.

19. The assembly of claim 1 further comprising a perforated pipe lying near the bottom of said space, running parallel to the chamber lengths, for introducing or removing liquid from said space.

20. The assembly of claim 19 further comprising: channel means for providing access to the perforated pipe and enabling pressurized water to be flowed into said pipe and through the perforations of the pipe, to agitate any settled out debris near the bottom of said space and to create debris-laden water which is flowable through the perforations of the pipe; and, channel means for receiving debris-laden water flowed from said perforated pipe, to enable removal of the debris-laden water from the assembly.

21. The assembly of claim 1 characterized by each chamber having a cross section aspect ratio of at least about 0.8 to 1, where aspect ratio is the ratio between the chamber height and chamber width measured at the base.

22. An assembly for receiving and dispersing stormwater when buried beneath soil, comprising:

a pair of chambers, each chamber having an arch shaped cross section defining a chamber hollow interior, a base, a top, and opposing perforated sidewalls running from the base to the top;

each chamber having corrugations comprised of peaks and valleys, running along sidewalls in an upwardly direction, transverse to the chamber length;

the chambers lying adjacent and parallel to each other on an essentially flat surface, the adjacent sidewalls of the chamber pair shaped and positioned relative to each other to create a space therebetween;

each chamber having sidewalls sloped inwardly at an angle of less than 15 degrees from the vertical;

each chamber having a cross section aspect ratio of at least 0.8 to 1, where aspect ratio is the ratio between the chamber height and chamber width measured at the base;

each chamber having an impost for supporting a bridge cover spanning said space; each impost having an elevation lower than the elevation of the highest part of the top of the chamber;

each chamber having opposing spaced-apart flanges running lengthwise along the base; the flanges of the adjacent chamber pair extending laterally toward each other, to abut and thereby establish between imposts of the adjacent chambers the desired impost spacing to fit a bridge cover;

an arch shape bridge cover spanning said space, supported on the imposts of the adjacent chambers, for preventing soil from entering said space from above when the assembly is buried in soil;

each chamber having perforations in the chamber sidewalls, to enable flow of stormwater between the space and each chamber interior; all the perforations located at an elevation higher than the level of the base, to create a cavity in the space near the base of the chambers where stormwater introduced into the space may accumulate and where debris may settle, before the stormwater flows into a chamber; and, means for introducing stormwater into said space.

23. The assembly of claim 22 further comprising chamber endplates closing the interiors of the chambers at the ends of each chamber, and a space endplate closing the end of the space spanned by the bridge cover; and, means for introducing stormwater into the space through said space endplate.

24. In a chamber for dispersing liquid when buried beneath soil, of the type wherein the chamber has an arch shaped cross section defining a hollow chamber interior, a base, opposing inward sloping sidewalls having substantially spaced apart sidewall upper ends, each sidewall running from the base to a curving arch shape top which connects said sidewall upper ends , and corrugations comprised of peaks and valleys running up the opposing sidewalls of the chamber and transverse to the lenght of the chamber, the improvement which comprises: the chamber having a cross section aspect ratio of at least about 0.8 to 1, where aspect ratio is the ratio between the chamber height and chamber width measured at the base.

25. The improved chamber of claim 24 wherein the chamber has inward sloping sidewalls with a sidewall angle with the vertical plane of less than about 15 degrees.

26. The improved chamber of claim 25 wherein the sidewall angle is about 6 to 9 degrees.

27. The improved chamber of claim 25 wherein at least one of the peaks and valleys of the sidewall has an acurate shape, as measured in a plane parallel to the base of the chamber.

28. The process of removing debris which has settled out at the bottom of a covered space in an assembly for receiving and dispersing stormwater beneath soil, wherein the assembly is comprised of a pair of adjacent arch shaped hollow cross section chambers having said space therebetween, wherein stormwater flows within the chambers and said space, which comprises: flowing water through a conduit lying near said bottom of said covered space so that the water discharges from the conduit and enters the space to agitate and suspend a substantial part of the settled out debris in liquid within the space; then, flowing said water with suspended debris from the space to a receiving point.

29. The method of claim 28 wherein the conduit is a pipe having perforations facing downward toward the bottom of the space, wherein water is flowed through the pipe to agitate the settled out debris by discharging it from a pressurized nozzle inserted within the pipe, and wherein the water with suspended debris flows from the space through said perforations and said conduit to a receiving point.

30. In a chamber for dispersing liquid when buried beneath soil, of the type wherein the chamber has an arch shaped cross section defining a hollow chamber interior, a top, a base, opposing sidewalls running from the base to the top, and corrugations comprised of peaks and valleys running up the opposing sidewalls of the chamber and transverse to the length of the chamber, the improvement which comprises: the chamber having inward sloping sidewalls with a sidewall angle with the vertical plane of less than about 15 degrees; and, the chamber having a cross section aspect ratio of at least about 0.8 to 1, where aspect ratio is the ratio between the chamber height and chamber width measured at the base.

31. The improved chamber of claim 30 wherein the sidewall angle is about 6 to 9 degrees.

* * * * *